United States Patent [19]

Rogers, Jr.

[11] Patent Number: 4,497,490

[45] Date of Patent: Feb. 5, 1985

[54] BOARD GAME AFFORDING COMPETITIVE CHALLENGE AMONG PLAYERS

[76] Inventor: Thurmond J. Rogers, Jr., 12011 Woolford Dr., Houston, Tex. 77065

[21] Appl. No.: 33,941

[22] Filed: Apr. 27, 1979

[51] Int. Cl.[3] ..... A63F 3/00

[52] U.S. Cl. ..... 273/249; 273/142 JA; 273/282

[58] Field of Search ..... 273/243, 256, 282, 284

[56] References Cited

U.S. PATENT DOCUMENTS

| | | | |
|---|---|---|---|
| D. 213,980 | 4/1969 | Tartack | 273/243 |
| 688,027 | 2/1901 | Toaspern | 273/284 |
| 884,674 | 4/1908 | Mason | 273/243 |
| 1,165,688 | 12/1915 | Maris | 273/262 |
| 2,026,082 | 12/1935 | Darrow | 273/256 |
| 2,174,058 | 9/1939 | McGennis | 273/256 |
| 2,484,051 | 10/1949 | Robbins | 273/256 |
| 3,759,520 | 9/1973 | Straitwell, Jr. | 273/243 |
| 3,807,739 | 4/1974 | Henley | 273/256 |
| 3,889,954 | 6/1975 | Masilow | 273/256 |
| 3,936,054 | 2/1976 | Garcia | 273/243 |
| 3,961,795 | 6/1976 | Anspach | 273/256 |
| 4,012,046 | 3/1977 | Liket | 273/243 |
| 4,032,153 | 6/1977 | Dawn | 273/256 |
| 4,201,338 | 5/1980 | Cantelon | 273/251 |

*Primary Examiner*—Richard C. Pinkham
*Assistant Examiner*—Matthew L. Schneider
*Attorney, Agent, or Firm*—Neal J. Mosely

[57] ABSTRACT

A board game apparatus is disclosed having a board with marked spaces or areas constituting a path of progression around the board. The apparatus includes token money as a medium or indicia of payment. Movement of playing pieces is by chance. Spaces or areas on the board provide instructions for further movement or the mode of exchange of tokens between or among the players. Cards are provided having selected values and are used by the players to challenge and to play competitively with each other. Strategy of play depends upon position on the board and the cards available to the players. Payments from one player to another may result from winning or losing a challenge situation or by chance as dictated by the indicia on a player's position on the board. The game involves a combination of chance or luck and skill in managing the cards drawn.

14 Claims, 22 Drawing Figures

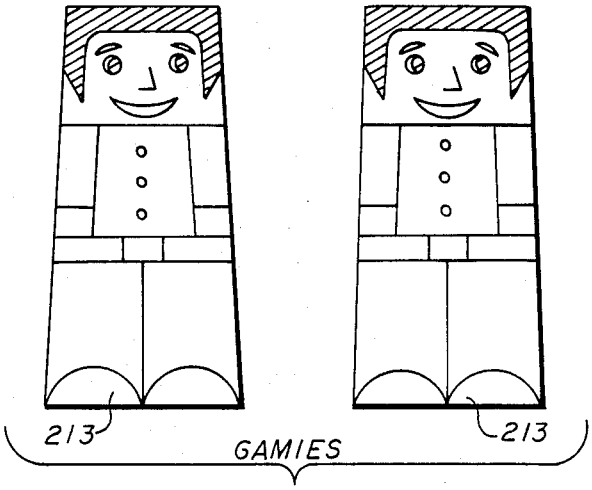
FIG.6
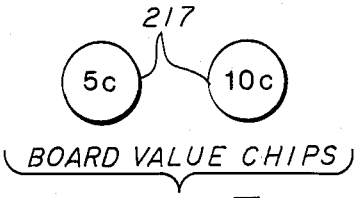
FIG.7
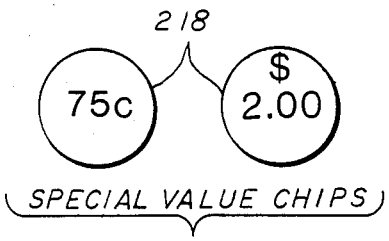
FIG.8
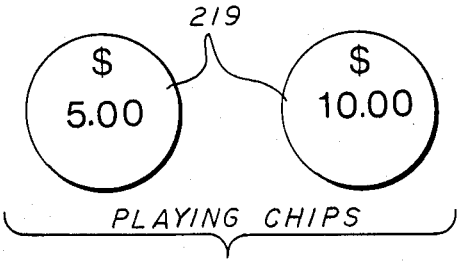
FIG.9
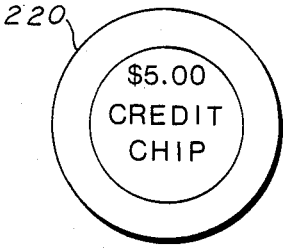
FIG.10
FIG.11A
MARKER
DATE _____
I.O.U.- _____
15% Re Pay To Loaner
5% Pay Cashier
20% TOTAL
circle amount borrowed:
$25.00 $50.00 $100.00 $1,000.00
Cashier Witness:
SIGNATURE DATE
Borrower:
SIGNATURE DATE
FIG.11B
MARKER
15% Re Pay To Loaner
| Loaned | | Interest | |
|---|---|---|---|
| $25 | 00 | $3 | 75 |
| 50 | 00 | 7 | 50 |
| 100 | 00 | 15 | 00 |
| 1000 | 00 | 150 | 00 |
5% Pay Cashier
| | | | |
|---|---|---|---|
| $25 | 00 | $1 | 25 |
| 50 | 00 | 2 | 50 |
| 100 | 00 | 5 | 00 |
| 1000 | 00 | 50 | 00 |
Cashier could receive All the interest if he Loaned all the money.
221

TEN PLAYERS "PLAYER EVALUATION"

| STATUS | TITLE | FORTUNE | CLASS |
|---|---|---|---|
| 1ST | PROFESSIONAL PLAYER | WON MOST MONEY | SUPERIOR |
| 2ND | SHARK | WON SECONTH IN MONEY | SKILLED |
| 3RD | GAMBLER | WON THIRD IN MONEY | EXCELLENT |
| 4TH | HIGH ROLLER | WON FOURTH IN MONEY | GOOD |
| 5TH | RISKY PLAYER | WON FIFTH IN MONEY | LUCKY |
| 6TH | AMATEUR | WON SIXTH IN MONEY | FAIR |
| 7TH | BEGINNER | WON SEVENTH IN MONEY | ? QUESTION ? |
| 8TH | BAD PLAYER | WON EIGHTH IN MONEY | BELOW PAR |
| 9TH | LOOSER | WON NINTH IN MONEY | HARD LUCK |
| 10TH | GOOD SPORT | LAST IN MONEY | GAMY |

"CRISS-CROSS EVALUATION"

3-4-5-PLAYERS

1st 1st 1st
2nd 2nd
2nd
3rd 3rd
4th 4th 3rd
5th

228

FIG.12

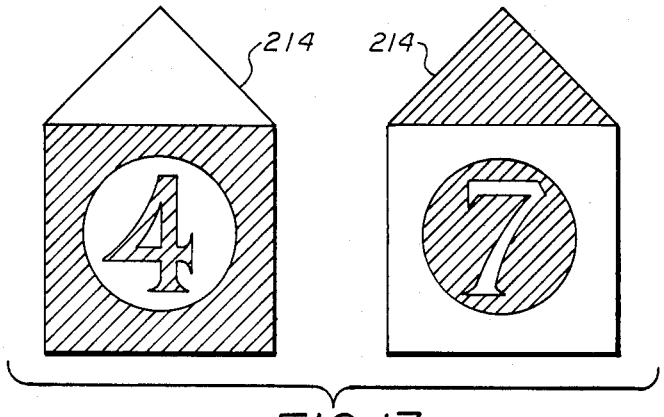

FIG.13

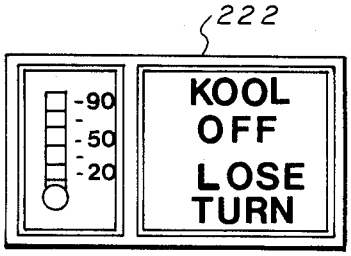

FIG.14

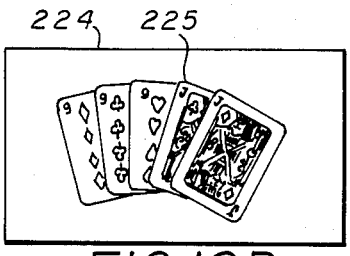

FIG.16B

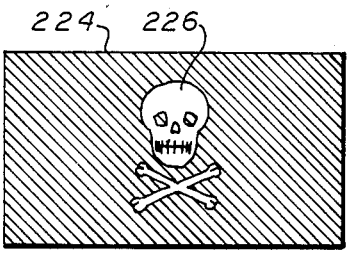

FIG.16C

CREDIT NOTE

| Amount Loaned by Cashier | Note Paid Before Game is Over Pay Cashier Interest | amount | Note Paid After Game is Over Pay Cashier Int. | Amnt. |
|---|---|---|---|---|
| 5.00 | 20% | 1.00 | 30% | 1.50 |
| 10.00 | 20% | 2.00 | 30% | 3.00 |
| 15.00 | 20% | 3.00 | 30% | 4.50 |
| 20.00 | 20% | 4.00 | 30% | 6.00 |

FIG.15A

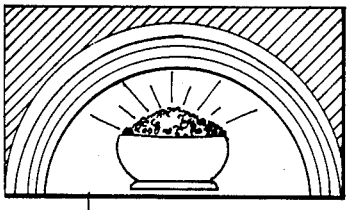

FIG.16A

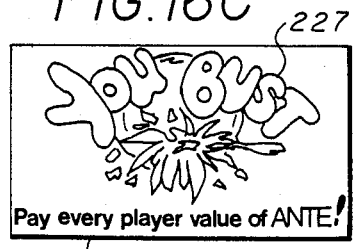

FIG.16D

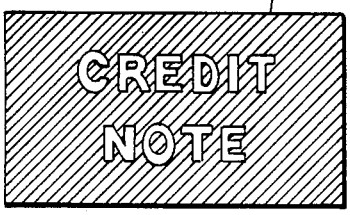

FIG.15B

BOARD GAME AFFORDING COMPETITIVE CHALLENGE AMONG PLAYERS

BACKGROUND OF THE INVENTION

1. Field of the Invention

This invention relates to new and useful improvements in board game apparatus, and, more particularly, to board games utilizing to the maximum elements of skill and chance.

2. Brief Description of the Prior Art

Board games have been known for many years in which playing pieces are moved along a path of playing spaces to reach a given destination in accordance with chance moves. The game of Pachisi is a game of that type having its origins in antiquity. There are board games of various types that have been known from the middle ages or earlier to the present time. In this century, numerous board games have been developed having various objectives for the moves of the pieces.

Darrow U.S. Pat. No. 2,026,082 discloses one of the most popular board games in the United States, viz. the game called Monopoly. In this game, real estate is sold, purchased, developed and rented in accordance with the rules of the game and a movement of the various playing pieces.

Strehlow, U.S. Pat. No. 2,666,644 discloses a board game involving the movement of playing pieces around the path and utilizing transactions and stock or other securities markets as the premise on which the game is based.

Copending U.S. Pat. No. 2,976,044 discloses a board game involving transactions in property.

Breslow U.S. Pat. No. 3,679,210 discloses a board game involving movement of pieces around a playing path and involving transactions in works of art.

Henley U.S. Pat. No. 3,807,739 discloses a board game involving movement of pieces around a playing board and involving financial transactions of various types.

Magiera U.S Pat. No. 4,032,154 discloses a board game involving movement of playing pieces around a path of progression on a board and simulating the activities of a mail order business.

The prior art as exemplified by the above-noted patents, discloses a variety of interesting board games, but each of these games requires a maximum element of luck and does not involve skillful utilization of playing position or playing cards against the other players.

SUMMARY OF THE INVENTION

One of the objects of this invention is to provide a novel board game apparatus.

Another object of this invention is to provide an improved board game apparatus utilizing maximum elements of skill and chance in the course of the play.

Another object is to provide a new and improved game board apparatus which involves a simulation of casino or gambling house activities in movement of playing pieces around a board.

Another object of this invention is to provide a new and improved game board apparatus involving a substantial level of skill and finesse in the play of card holdings of one player against another.

Other objects of this invention will become apparent from time to time throughout the specification and claims as hereinafter related.

The above-mentioned objectives are attained in this board game apparatus, which comprises a board having marked spaces or areas constituting a path of progression around the board. The apparatus includes token money as a medium or indicia of payment. Movement of playing pieces is by chance, viz. a spinner indicating spaces to be moved. Spaces or areas on the board provide further instructions for further movement or for the mode of exchange of token money between or among the players or between the players and the house. Cards are provided having selected values and are used by the players to challenge and to play competitively with each other. Strategy of play depends upon position on the board and the cards available to the player to challenge other players. Payments from one player to another may result in winning or losing a challenge situation or by chance as dictated by the indicia on the players' position on the board. The board is also provided with structural features for varying the amount of payment due from a player to the house or from one player to another according to the desires of the players. The game involves a combination of chance or luck and skill in managing the cards drawn and the position occupied on the board.

BRIEF DESCRIPTION OF THE DRAWINGS

FIG. 6 is a view of two of the playing pieces or gamies.

FIG. 7 is a plan view of two representative value chips used in recesses on the playing board.

FIG. 8 is a plan view of two larger special value chips used at certain selected positions on the playing board.

FIG. 9 is a plan view of two of the ordinary playing chips.

FIG. 10 is a plan view of a loan or credit chip.

FIGS. 11A and 11B are opposite sides of a marker or IOU document used in the game.

FIG. 12 is a plan view of a player evaluation chart.

FIG. 13 is a plan view of two representative player number cards.

FIG. 14 is a view of one side of a card entitled, "KOOL OFF LOSE TURN".

FIGS. 15A and 15B are opposite sides of a credit note issued to players in the game.

FIG. 16A is the cover or back of playing cards called FINESSE CARDS used in the game.

FIG. 16B is the reverse side of a FINESSE CARD having a playing hand.

FIG. 16C is the reverse side of a FINESSE CARD called a KILLER CARD.

FIG. 16D is the reverse side of a FINESSE CARD called a BUST CARD.

DESCRIPTION OF THE PREFERRED EMBODIMENT

Figure 1A:
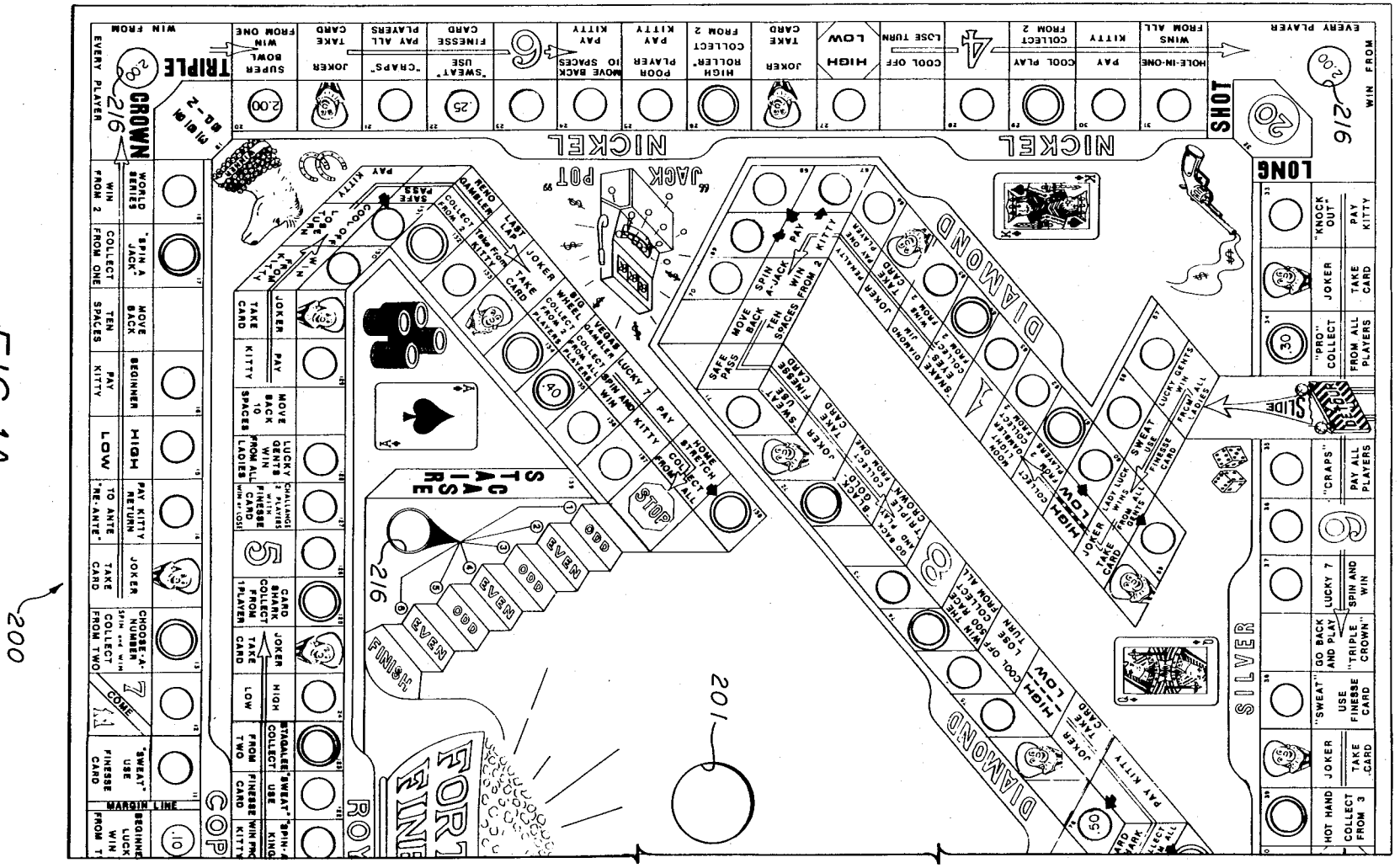
FIGS. 1A and 1B of the drawings disclose the right half and left half, respectively, of the playing board for a preferred embodiment of the board game comprising this invention.
Figure 1B:
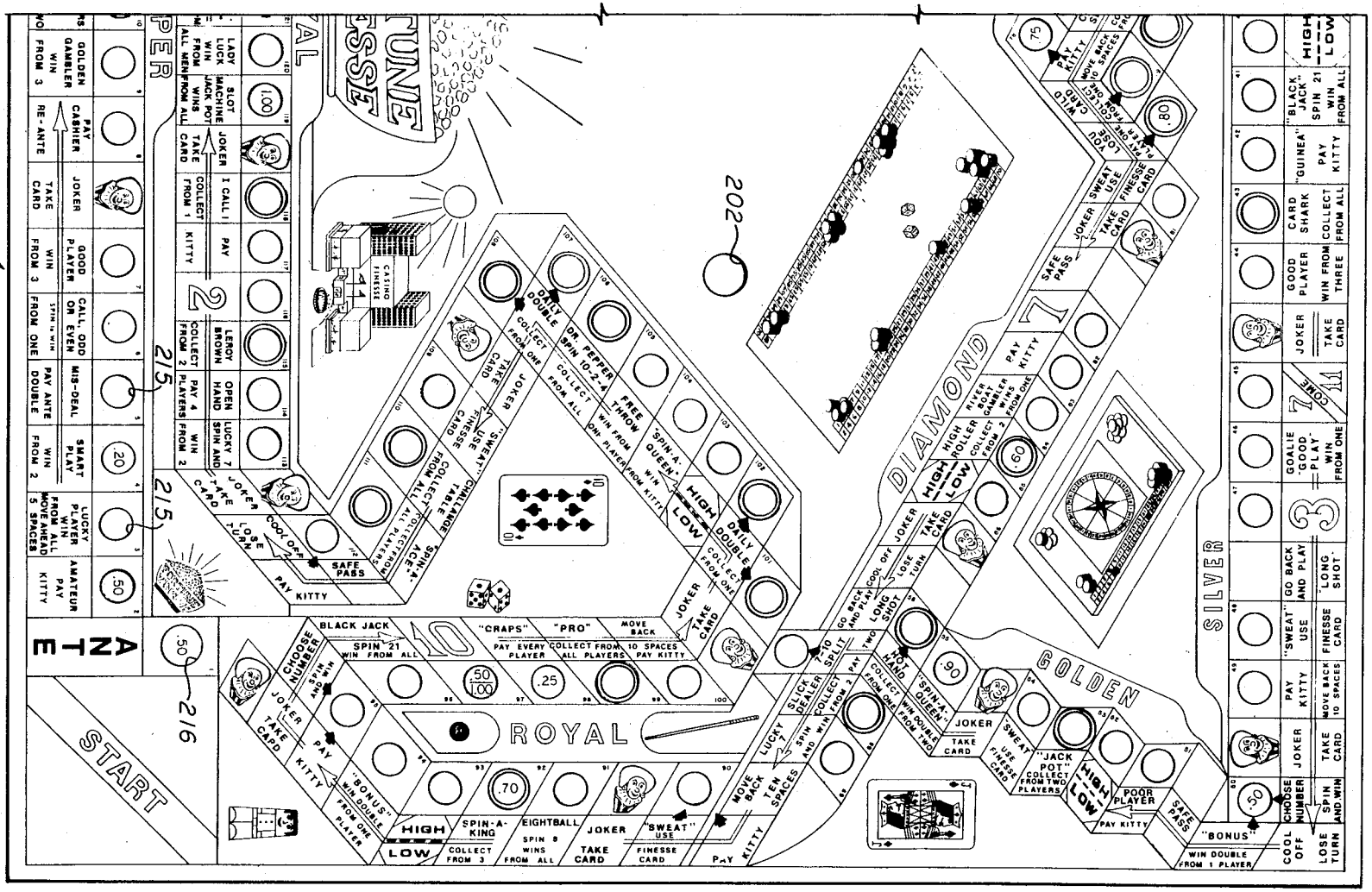
Figure 2:
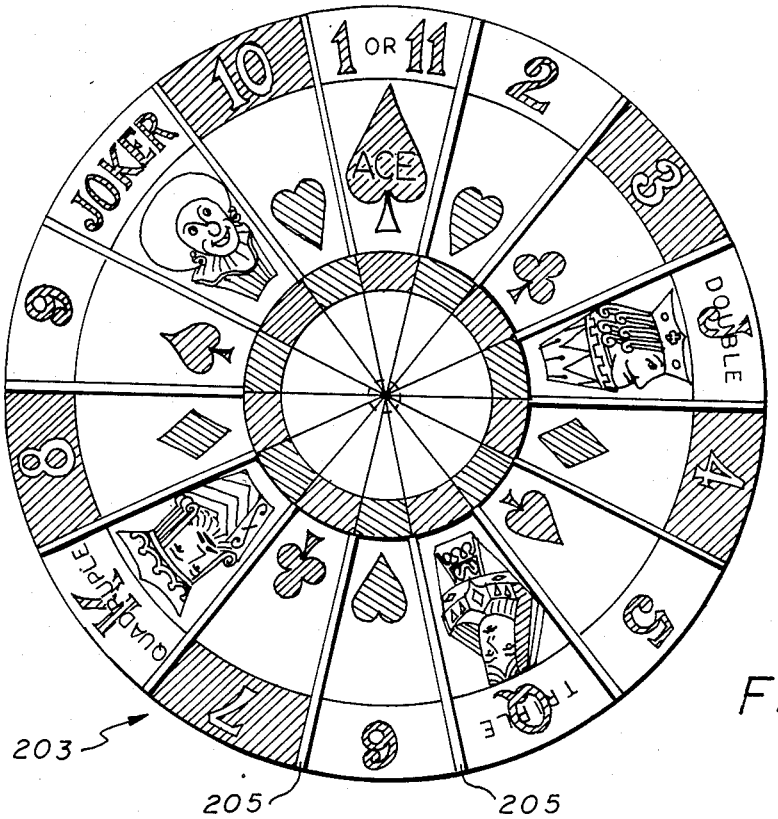
FIG. 2 is a plan view of a spinner for indicating chance moves of playing pieces.
Figure 3:
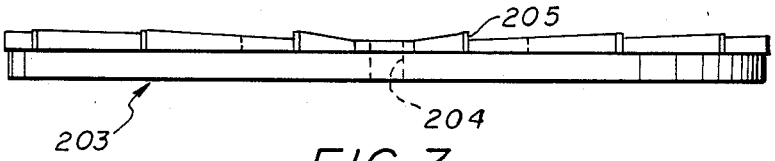
FIG. 3 is a side view or an elevation of the spinner shown in FIG. 2.
Figure 4:
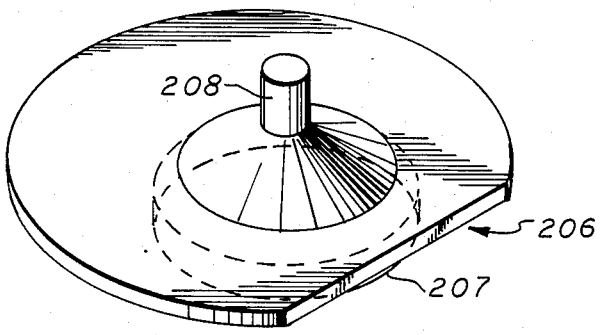
FIG. 4 is an isometric view of the support for the spinner shown in FIGS. 2 and 3.
Figure 5:
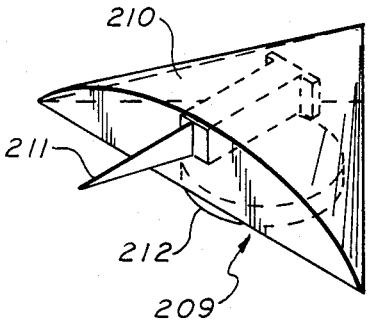
FIG. 5 is an isometric view of the pointer for the spinner shown in FIGS. 2 and 3.

Referring to the drawings, and, more particularly, to FIGS. 1A and 1B, there is shown a playing board 200 for a board game entitled, FORTUNE FINESSE. The playing board 200 has a plurality of marked playing spaces numbered 1 to 139 and individually labeled with playing instructions. The individual playing spaces will be referred to where necessary by either the space number of the indicia or identification of the playing space.

Playing board 200 is a folding board of substantial thickness and is provided with recesses 201 and 202 in the surface of the board.

Game board 200 is provided with a spinner 203 having a center aperture or hub portion 204 and having a radially extending flanges 205 dividing the surface of the spinner into discreet indicia marked areas. A support 206 is provided for spinner 203 and has a circular boss 207 extending from the underside thereof, and a supporting pin or axle 208 extending from the upper side. Boss 207 is of a size designed to fit snuggly into recess 201 on the surface of playing board 200. Supporting pin or axle 208 is of a size to fit smoothly in hub or aperture 204 for spinner 203 and allows for free rotary movement of spinner 203 thereon. The spinner is provided with a cooperating pointer member 209 having a main support 210 a pointer 211 and a cylindrical boss 212 extending from the base thereof. Boss 212 is of a size and shape to fit snuggly in recess 202 on playing board 200. When pointer member 209 is supported in position, pointer 211 extends over the surface of spinner member 203 and interferes with the free rotation of the spinner. Pointer 211 is quite flexible so that spinner 203 may be spun and pointer 211 will gradually slow down the rotation of the spinner and, finally, indicate the point at which the spinner has stopped.

The moving pieces used by the players in the game are the gamies 213 shown in FIG. 6. The gamies are provided in a plurality of different colors and are in a number sufficient to accomodate up to ten or more players. Players are also provided with player number cards 214, shown in FIG. 13, which are of the same size and shape, with each card having a different number and a different color. These cards are assigned to the players on a random basis as will be described in connection with the description of play. Each of the playing spaces is provided with a recess 215 which is of a size to receive disc-shaped chips having indicia indicating values to be assigned to each playing space. Spaces 1, 19, and 32 have special significance in the game and have slightly enlarged recesses 216. The other playing spaces having these recesses have the smaller recesses 215. The game is provided with a plurality of board value chips 217, shown in FIG. 7. These chips are, preferably ½" O.D.×1/16" thick and made of plastic. The chips have different values on opposite sides. There are nine different chips having the following indicia on opposite sides (1) 5¢-60¢ (2) 10¢-70¢ (3) 15¢-75¢ (4) 20¢-80¢ (5) 25¢-90¢ (6) 30¢-$1.00 (7) 40¢-$2.00 (8) 50¢-$5.00 (9) 50¢-$1.00 on one side and $1.00-$2.00 on the other side. These gray plastic tokens fit the recesses 215 and are placed around the playing board in a selected manner as set forth in the game description or as modified by the desires of the players. Special value tokens or chips 218 are shown in FIG. 8. These chips are slightly larger in size, e.g. ⅝" O.D. and are designed to fit the recesses 216 in playing spaces 1, 19, 32 and 139. The special value chips 218 are of gray plastic and of a size ⅝" inch O. .×1/16" thick. There are three sets of the chips 218 having different values on opposite sides, viz. (1) 25¢-$1.00 (2) 50¢-$2.00 (3) 75¢-$5.00. The players are also provided with somewhat larger playing chips which are ⅛"×1⅛" O.D. of red plastic. There are eight different chips in the denominations 5¢, 10¢, 25¢, 50¢, $1.00, $5.00, $10.00 and $20.00. These chips, numbered 219, are shown in FIG. 9. In addition, there is still another type of playing chip, the credit chip or loan chip 220, shown in FIG. 10. This is a chip of distinctive color, bearing indicia on its face of a certain amount, e.g. $5.00 (credit chip). The chip is preferably ⅛"×1½ O.D. This chip is oversized and distinctive in color and bears the credit indicia so that it can be easily distinguished in play.

There are several types of cards used in the play of the game. There are individual slips or markers 221, shown in FIGS. 11A and 11B (which are opposite sides of the same slip) which are used for handling loan transactions in the course of the game. In FIG. 14, there is shown a card 222 marked KOOL OFF LOSE TURN. The use of this card will be described later. In FIGS. 15A and 15B, there are shown opposite sides of a credit note card 223 which is used in credit transactions and will be described more fully hereinafter. In FIG. 16A, there is shown the back of the FINESSE PLAYING CARDS 224. Certain of the cards 224 bear playing hand indicia 225 which indicate different poker hands. These cards are called "FINESSE CARDS". Certain of the cards 224 have the death's head indicia 226 thereon and are called "KILLER CARDS". Still others of the cards 224 bear the indicia "YOU BUST" 227 thereon. These are called "BUST" cards. The manner of use of the FINESSE cards, the KILLER cards and BUST cards will be described more fully in connection with the description of play of the game. Finally, there an evaluation 228, shown in FIG. 12 which is used in player evaluation at the end of the game.

Before describing the sequence of play in detail, it is necessary to understand the terminology used in this game and also the rules of the game. Consequently, this explanation begins with a series of definitions and a set of rules of the game and is addressed to the reader as an individual who is learning to play the game.

VOCABULARY AND DOCUMENT DEFINITIONS

Alphabetically Ordered

Aces

One space on the Spinning Wheel 203 marked 1 or 11. Before one crosses the Margin Line, and Ace will count as 1. After crossing the Margin Line, Aces will count 1 or 11. This means one can move 1 or 11 spaces. Also, the Ace will be used in Black Jack and Long Shot as 1 or 11.

Ante

Each player will pay the full value of the Ante to the Ante Tray before they will be allowed to spin again and move forward. Each player must spin any number 1 to 10 to move their Gamie 213 off Ante for their official play of the game to start. It is possible a player could be Scratched and moved back to Ante. If this happens, he will not have to Re-Ante, but will have to spin a 1 to 10 to start his play again.

Ante Tray

The container where every player pays the Ante Value.

Arrows

1. The Big Arrows are on all the Strips. They direct each player how to move their Gamie 213 from the Start to the Finish.
2. The Small Arrows are pointed from the Document Spaces showing their Values.

Black Jack

1. When a player occupies this Space, he will try to spin 21 in two spins of the Wheel 203. This is Black Jack, and the player will win the Highest Value of the Space from all players.
2. When a player spins the Wheel five times without busting 21, he will win the Lowest Value of the Space from all players.
3. When a player spins over 21, he busts, and may pay the Kitty the Lowest Value of the Space.

Bust Card

There are six Bust Cards 227 in the Finesse Cards. Refer to Rule 3, below.

Cashier of the House

The Judge and Coordinator of the game. Refer to Rule 1, Below.

Challenge

One player competing against the other players, using his Finesse Card 225 against the other players' cards to win money.

Challenge Table

Challenger to play one Finesse Card 225 against all the opponent players' cards that are occupying a Value Space. The Challenger cannot tie or lose to one player or he loses the Challenge. While the Wheel is spinning the Challenger must speak outloud for all to hear: "I Challenge the Table."

Challenge Table Use Finesse Card—Win or Lose Document

When a player occupies this Document Space, he must Challenge the Table. He must defeat all the players of The Table that are occupying a Value Space. If only one player of The Table ties or has a better Finesse Card, then the Challenger will have to pay all the players and Kitty the same per player the Value of the Space he occupies. If the player that had to Challenge has the winning Finesse Card, he will collect Double from each player their Value Space. If none of the opponents occupy a Value Space, the play is dead. There is only one of these Documents in the game, and it is located on the Royal Strip, (Space #110). A Document Challenge will over rule a Vocal Challenge. The Vocal Challenge will be off.

Collect Or Win Spaces

If the Document does not determine the number of players to collect from, then one will collect from all the players.

Collect or Win (Spin) Spaces

If the Document does not determine the number of players to collect from, then one will collect from all the players.

Cool Off Lose Turn

The player that lands on this Document will lose his next turn. If a player is Scratched on this Document he will move back ten spaces and will not be liable for the play or what the Document reads, but he will be able to play his next.turn. The player that takes over his Space will lose his next turn. Anytime a player occupies this Document, the Cashier will issue him a (KOOL) OFF LOSE TURN CARD, 222.

Credit Chips

When a player needs to borrow money, they will be issued these Chips 220 by the Cashier. The Cashier will be able to keep track of the money loaned out by the number of Chips 220 given to each player. Refer to Rule 10, below.

Credit Note

A Note 223 given to a player when he is loaned money by the Cashier. On the back of this Note, 223, is a Chart detailing Interest Rates to be paid back before and after game, and which also has the amounts player can be loaned. Refer to Rule 10, below.

Daily Double

This document has two Value Spaces, therefore, it pays Double.

Detour Space

Anytime a player occupies the Detour Space, he must detour. A player can choose which Strip he wants to play, as long as he does not land on Detour.

Documents

The readings of all the Play Spaces on the Board Strips that determine what each of the players are to do.

Evaluation Chart

Quotes exactly how good a player is by the amount of money he wins. If a player owes the House money after the game is over, and does not pay the money back, he will be rated as a Poor Risk for next game. Cashier is responsible for reading the Chart after game is over.

Finesse

Clever execution, witty play, intelligent and smart tactics.

Finesse Cards

The Cards 225 used to Challenge.

Fortune

Total amount of money won. The Pot of Gold under the Rainbow.

Game Chips

The colorful Chips 219 used for money.

Gamie

The given name of the Objects 213 the players use to move from one space to another.

High/Low

When a player occupies this Space, he will have a chance to spin the Wheel one time. While Wheel 203 is spinning, the player will speak out loud "High" or "Low".

1. If a player declares "High" and the Wheel stops on 8, 9, or 10, he will win the Value of the Space from all the players.
2. If a player declares "Low" and the Wheel stops on 1, 2 or 3, he will win the Value of the Space from all the players.
3. If the Wheel lands on 4, 5, 6, or 7, the player will pay the Kitty the full Value of the Space.

Joker

The Clown on the Spinning Wheel 203. The joker is not wild. If a Joker is spun on the Spinning Wheel, after a player is off the Start, that player will draw one Finesse Card 224 and stay on the Space he occupies. Refer to Rule 8.

Joker Take Card

Anytime one occupies one of these Sapces, he will be entitled to draw one Finesse Card 224.

Killer Card

The Finesse Card with the Skeleton Head and Crossbones, 226.

Kitty

The penalty money

Ladies Luck

If the Ladies land on this Document Space, they will win the Value of the Space from all Gents.

Liable

A term that makes all the players responsible for their Documents, Spins, Challenges and Plays.

Long Shot

When a player occupies this Document Space, he will have a chance to spin the Wheel three times. If the player spins the Total number of 20 by adding all the spins together, he will win the amount the Document reads. If not, he wins nothing. A player cannot be Scratched on this Space. More than one Player can occupy this Space Aces count 1 or 11, King counts 10, Queen counts 10, Jack counts 10, and all the other Numbers their amount. Joker counts as a spin only.

Lucky Gents

If the Gents land on this Space, they will win the Value of this Space from all Ladies.

Margin Line

The Line between the 10th and 11th Spaces at the beginning of the game. All players must cross this Line before they can be Scratched, Busted, Challenge or be Challenged, play the Royal Court, spin his own Number or 11 to count 11 on the Spinning Wheel.

Markers

These are the I.O.U. Pads 221. Refer to Rule 10, below.

Occupied Document

At no time can two players occupy the same Document Except: Start, Ante, Triple Crown, Long Shot, Stop and Staircase.

Playing Partners

All players will play as if they are playing by themselves. At the end of the game, the partners will add their winnings together.

Player Numbers (Pointer Cards)

The Player Numbers 1 to 10 are printed on these Cards 214. Each player will own one number before the game starts. There are five Odd Numbers: 1, 3, 5, 7, 9 and five Even Numbers: 2, 4, 6, 8, 10. These Numbers are also on the Playing Board Refer to Rule 2, below.

Re-Ante (After Finish)

After the first player crosses the Finish, all the other players can voluntarily Re-Ante the present Value of the Ante. Each time a player crosses the Finish, this can be repeated. Each time a player crosses the Finish, he will win the amount of Chips in the Ante and the Kitty.

Royal Court

Consists of three Faces: King, Queen and Jack, on the Spinning Wheel. A Royal Court play is not in effect until a player crosses the Margin Line. Refer to Rule 7, below.

Royal Flush

There are four Royal Flushes in the Finesse Cards 225. A Royal Flush is: Ace, King, Queen, Jack and 10, all of one suit in sequence. This is the Highest hand in the game. Refer to Rule 6.

Safe Pass

This Space has no value. A player cannot be Scratched, Busted, or Challenged while occupying this Space. If a player draws a Bust Card, he will return it to the Cashier to be reshuffled and draw another Finesse Card 224.

Scratched

When one player moves forward to a Space which is already occupied the player that occupied this Space, will be penalized to move backwards 10 spaces. All players must be over the Margin Line before they can be Scratched. Refer to Rule 9, below.

7 Come 11

When a player occupies this Space, he will spin the wheel one time. If the player spins a 7 or 11 he will win the Value of the Space from all players.

Show Down

The last time every player can use their Finesse Cards 224, against each other after crossing the Finish Refer to Rule 12.

Slide

Slide does not count as a Space for moving Gamie 213.

Spinning Wheel

The Wheel 203 in the center of the Playing Board 200 that each player spins when it is their turn. The Wheel is composed of 14 separate sections in a clockwise order: 1 or 11 Aces, 2, 3, Jack, 4, 5, Queen, 6, 7, King, 8, 9, Joker and 10. Everything on this Wheel will determine how you will play the game.

Staircase

When a player reaches this point, he is ready to Finish the game. If he has an Odd or Even Player Number, he will have to spin the Wheel on his turn to determine if he can move a Step closer to the Finish. The first player to the Finish will win the money in the Kitty and the Ante. If a player has an Even Player Number, he must spin an Even Number on the Spinning Wheel in order to move one Step on the Staircase. Same goes for Odd Player Numbers. The Joker, Jack, Queen and King will count as spins if spun on the Spinning Wheel. They have no value for moving Gamie. If a Joker is spun while occupying the Staircase, that player will draw one Finesse Card. All players can be Challenged or they can Challenge while occupying the Staircase, because each Step has a Value. All players can be Busted on these Steps.

Standard Numbers

The Standard Numbers are the small numbers printed on each Value Space on the Playing Board from the Start to the Finish numbered in sequence 1 thru 139. These Numbers will guide the players in setting up the Playing Board Value Spaces in sequence to the Standard Playing Board Value Chart.

Stop

The last Space on the Playing Board that all the players will Stop at before proceeding down the Staircase. No matter what number is spun, the player will Stop on this Space. This Space has no Value; one cannot Challenge, be Challenged, or Scratched on this Space. One can Bust on this Space.

Strips

All the Documents added together to form six sections on the Playing Board. These sections are called Strips. There are six strips called: Copper, Nickel, Silver, Diamond, Golden and Royal.

"Sweat" Use Finesse Card

Anytime a player occupies this Document Space he must use one Finesse Card 224 against all the opponent players. All the players occupying a Value Space will have to use one Finesse Card. The player that has to play against all the other players can win from one, two or three players, or lose to one. Either way, he will pay only to the players he loses to, plus pay the Kitty the same per player, or collect from the players he beats in the same play. If there are no players occupying a Value Space, the player that had to play against all the other players will pay the Kitty the Value of the Space he occupies, then play is over. This Document Play will over rule a vocal Challenge. The vocal Challenge will be off.

The Table

All the players involved in the game.

Token Pick

A solid piece of plastic used to remove the Value Chips from the Value Spaces on the Playing Board.

Triple Crown

The players occupying this Space will immediately do what the Document reads. A player can be Challenged while he occupies this Space. A player cannot be Scratched on this Space. More than one player can occupy this Space.

Value Chips

These chips 217 are all the same color gray and can be interchanged in and out of the Playing Board Value Spaces to change the Value of the game from Low to High.

Value Spaces

These are the counter sunk holes 215 on the Playing Board above the Documents, where the Value Chips are placed.

The Rules of the Game are set forth as follows:

RULES OF THE GAME

Rule 1: Cashier of the House

Before the game can start:

The first procedure will be to appoint the Cashier of the House. This will be accomplished by the player placing all the Pointer Player Number Cards (214) 1 through 10 face down on the Playing Board, shuffled. Each player will draw one Player Number and this will be his Number and Title through the entire game. The player that draws the Highest Player Number 214 will be appointed the Cashier of the House. He may relinquish this Title to the next player with the Highest Player Number if desired.

The Cashier's job is to be the Judge and Coordinator of the game, controlling the play of the game according to the rules. He has the right to dismiss any player of the game with just cause. The Cashier will issue at this time only: Gamies 213, Finesse Cards 224, and Chips 219. He will be responsible for issuing the correct amount of Playing Chips 219 in accordance to the number of players in the game. Refer to How To Play Game Step By Step, 7th Paragraph for this information. The Cashier will be responsible for controlling the Playing Chips 219, Credit Notes 223, Credit Chips 220, Markers 221, Kool Off Lose Turn Cards 222, and all loaning and collecting procedures with Interest before or after the game is over. The Cashier will receive that amount of Interest on the back of the Credit Note Cards 223, the Markers 221 and also 10% of the original Kitty, only after the game is finished.

The Cashier will start the game off by spinning the wheel first and seeing that all the players spin the wheel in a clockwise order on their turn. He will see that all the players spin the wheel correctly. The wheel must rotate at least five revolutions to be a correct spin, or that player will have to spin over. He will be responsible to see that all the players pay the Ante and the Kitty, abide by all the Document Readings, make their Challenges clear and correct and use their Finesse Cards according to the rules. The Cashier will always collect the amount of the Ante from any player that fails to draw or exposes a Finesse Card 224. The Cashier has a big job and may depend on the other players for help. The Cashier will not settle up on the Ante or Kitty until the game is completely over so as to keep from interfering with the other player' play of the game.

After the game is over, the Cashier will read the Evaluation Chart 228 describing each players' Game Status and Ranking.

Rule 2: Players Numbers

There are 10 separate numbers printed on individual Pointer Cards, 1 through 10, consisting of 5 Odd Numbers, 1, 3, 5, 7, 9 and 5 Even Numbers 2, 4, 6, 8, 10. These Numbers (214) will be shuffled and placed on the Playing Board face down. Each player will draw one Number and that Number will determine if a player is Odd or Even. Once a player has established this Title of being Odd or Even, it will be his for the entire game. Each players' Number must be placed in front of him at all times, with the Number facing up, pointing toward the Playing Board visible for all the players to observe. All these Numbers are very important as will become apparent while playing the game.

A player may Challenge the opponent players by simply speaking out loud the Players' Numbers. Refer to Rule 5 for "How to Challenge" procedure.

The Highest Player Number drawn will be appointed the Cashier of the House and he will spin the Spinning Wheel first to start the play of the game. After the Cashier has issued all the game Pieces, and all the players' Gamies 213 are on Start, each player will have their chance to spin an Odd or Even Number on the Spinning Wheel 203. If you own an Odd Title, you must spin an Odd Number on the Spinning Wheel 203 to be eligible to advance to the Ante. Same procedure for Even Title. Each player will have three different turns to spin the Wheel, trying to advance from the Start to the Ante. If a player fails to spin an Odd or Even Number, one of which pertains to his own Title, on his third turn, that player will automatically advance to Ante, pay Ante and immediately spin again to start his play of the game. Once a player is off the Start, he will follow the rules of the game and will be able to spin and move his Gamie 213 on any number spun on the Spinning Wheel. The only other time a player will have to worry about his Odd or Even Title is when he tries to move his Gamie Step by Step on the Staircase to the Finish. If a player has an Even Title, he will have to spin an Even Number in order to move his Gamie one step close to the Finish. Each player must move his Gamie on all three of the Steps of the Staircase in order to Finish. Same procedure is used for Odd Title.

There are six Strips on the Playing Board, and on these Strips there are 1 through 10 Player Numbers identical to the Number each player drew before the game started. Each player has one Player Number on the Playing Board Strips, and at no time can a player that is occupying his own Number be Scratched or Challenged.

1. If a player makes the mistake of Challenging a player that is presently occupying his own Player Number an the Strip, the player that Challenged will pay the owner of the Number the Highest value of the Space.
2. If a player occupies his own Number on the Strip, he can Challenge the opponent players if he desires.
3. Anytime a player occupies his own Number on the Strip, he will collect the Highest value of the Space from all the players in the game.

4. If a player is occupying his own Number on the Strip and an opponent player happens to land on this Number, the player that landed on the Number will pay the owner of the Number the Highest value of the Space, and then move back ten Spaces and play the Document he lands on.
5. Anytime a player lands on a Player Number on the Strips, he will pay the owner of that Number the Highest Value of the Space.
6. Anytime a player lands on a Player Number on any of the Strips and no one owns that Player Number, the player that landed on the Number will have to pay the Kitty the Lowest Value of the Space.
7. After a player crosses the Margin Line and spins his own Player Number on the Spinning Wheel, he will be entitled to collect from one player of his choice the Highest value of the Player Number Value Space on the Playing Board.

Rule 3: Finesse Cards

There are 100 Finesse Cards 224. These Cards are made up of different Poker Hands 225. Four Royal Flushes 225, 20 Killer Cards 226 and 76 other different types of Finesse Cards bearing symbols of various poker hands. The Finesse Cards, when produced on a Challenge, will determine the outcome of the play. Before the game starts, every player will receive from the Cashier one Finesse Card. After the game is started, it will be up to each player to draw his own Finesse Card. At anytime a player is caught without a Finesse Card, they will be penalized. The penalty for forgetting to draw a Finesse Card after your turn is over, is paying the present Value of the Ante to the Kitty, Cashier and to the player that will spin the Wheel next. Once the wheel stops, the penalty can be exercised by the Cashier. Any player can call this to the attention of the Cashier. As soon as the penalty is paid, that player will be entitled to draw a Finesse Card. After a Finesse Card has been used, it must be returned to the bottom of the original stack. If it was the only Finesse Card the player had at that time, he will draw another Card before the next player spins. If a player has more than one Card and uses one, he will not be entitled to another Card as long as he has one left in his hand. Anytime a player lands on a Joker Take Card Space, he will draw one Card. After a player is off the Start and that player spins the Joker on the Spinning Wheel, he will draw one Card. A player will not be penalized for forgetting to draw a Finesse Card on these two plays, for his penalty will be no Card. If a Finesse Card is exposed by mistake, etc., the player that owned that Card will pay all the players the Value of the Ante, plus return the Finesse Card to the bottom of the stack and immediately draw another Card, if it was the only Card he had at that time.

Bust Card

There are six Bust Cards 227 in the game. If a player is issued a Bust Card by the Cashier of the House before the game starts, that player will immediately turn the card face up on the Playing Board and at that time the Cashier will issue him another Finesse Card. At no time can the game be played until the Bust Card play is settled. All players must cross the Margin Line before a Bust Card will be in effect. If a player draws a Bust Card before he crosses the Margin Line, that player will turn the card over for all the players to view. The Cashier will return the card to the original stack and reshuffle the cards in the stack. Once a player crosses the Margin Line and draws a Bust Card, he will pay each player in the game the value of the Ante, and move backward to the first open Joker Take Card Space; this will entitle the player to draw another Finesse Card. If the first Joker Take Card Space is occupied, the player will continue backward until he lands on a Joker Take Card Space that is open. If a player has just crossed the Margin Line, and he draws a Bust Card, that player will move backward to the Joker Take Card Space. If the Joker Take Card Space is occupied, the player that Busted will continue backward to the Ante Space. He will not be required to Ante again, and is still entitled to draw another Finesse Card.

If a player draws a Bust Card and fails to show it immediately to the players in the game, he will be penalized by paying each player double the Ante, and then move backwards to the Joker Take Card Space that is open. All players must turn their Finesse Cards 224 over at the end of the game. If a player is caught with a Bust Card in his possession after the game is finished, that player will forfeit the Kitty and Ante. All players can be Busted while occupying the Staircase. A player cannot be Busted while occupying the Safe Pass Document. He will return the Bust Card to the Cashier to be reshuffled and draw another Finesse Card Rule 4: Killer Card These Finesse Cards 226 can be used to make a Challenge or to counter a Challenge. All Killer Cards 226 are equal, and when used against each other will nullify the play between the players involved. Two Killer Cards when produced will defeat a Royal Flush. This is the only time a player can produce another Finesse Card.

One Killer Card when used by a player on a Challenge or to counter a Challenge, will beat all 76 of the other Finesse Cards hands listed below:

Straight Flush
Full House
Straight
Two Pair
Four of a King
Flush
Three of a King Killer Card Document Play If a player occupies a Document which reads or entitled him to win money from the other players, and he chooses the players he wants to collect from, at that time the opponent player may produce a Killer Card to avoid paying him. This does not pertain to: Pay Kitty, Cashier, Ante, Craps, Players Numbers or Penalties. Once a player has chosen the players he wants to collect money from, he cannot retract his choice.

Rule 5: Object of Challenge

The purpose of making a Challenge would be to wait until the opponent players are on a large Value Space so the Challenger can play his Finesse Card to win more money. This is "FINESSE"

Challenge;

The only time a player can Challenge is when it is his turn to spin the wheel 203. The Challenger can Challenge the Table or any number of players he prefers, providing they occupy a Value Space. The Challenger will also have to occupy a Value Space after his play. The Challenger will not have to declare who he Challenges until the present play is played or Game is moved. Once a Challenge is made, it cannot be retracted. If one Challenges and moves to a Document that requires one to Challenge or Sweat Use Finesse Card, he will play the Document only and the vocal Challenge is off. A player must be across the Margin Line before he can Challenge or be Challenged.

How to Challenge: Step by Step

[A] One can Challenge only on his turn, after he crosses the Margin Line.

[B] Spin the Wheel. While wheel is spinning, one should speak out loud for all players to hear, "I Challenge" or "I Challenge the Table."

[C] After the wheel has stopped, you will execute the play the Spinning Wheel has determined first.

[D] The Challenger must occupy a Value Space after his present play for the Challenge to stand.

[E] The present play will determine if one stays or moves to a different space. Either way, the Challenge is good if you still occupy a Value Space.

[F] If present play places one on a space of no value, the Challenge is off.

[G] If one Challenges by accident and no opponent player occupies a Value Space, he will pay the Kitty the amount of the game Ante Value.

[H] If the present play is good for Challenge to stand, then one will declare which players (one, two or all players) he wants to Challenge.

[I] One will play one Finesse Card against the opponent players Finesse Cards. All players involved in the Challenge will place one Finesse Card face down on the Playing Board and all the players will turn their cards over at the same time. Once a Finesse Card has been exposed, it cannot be retracted.

[J] On a Challenge, all the players are against the Challenger. Their Finesse Cards are no good against each other. Their play is strictly to defeat the Challenger.

[K] The best Finesse Card wins the Challenge.

Example: Regular Challenge

If one Challenges, he could win from two players and lose to one player, depending on how many players he has Challenged.

Challenge Table

[A] As defined in the Vocabulary, the Challenger must defeat all the players occupying a Value Space. If he ties or loses to just one player, he loses the Table Challenge and will have to pay all the players his Value Space plus pay the Kitty the same per player.

[B] If the Challenger defeats all the players on a Table Challenge, he will collect from each player double their Value Space.

[C] If a Royal Flush Finesse Card is used on a Table Challenge by the Challenger he will win Triple from all players involved. Refer to Rule 6, below.

Rule 6: Royal Flush Challenge

If the Highest Finesse Card in the game is used on one particular play, it will be placed on the game board face down. At that time, all the players that were Challenged will do the same. All the players involved in the Challenge will turn their Finesse Cards over at the same time. The only time one player can produce one more Finesse Card to make a total of two in the Challenge play will be to defeat a Royal Flush Finesse Card. It takes Two Killer Cards to defeat a Royal Flush Card. At no time can the opponent players Finesse Cards be combined to defeat a Royal Flush Finesse Card. Whenever a player Wins a Challenge with a Royal Flush Finesse Card, he will Collect Double from each player involved in the Challenge, the Value of the Space they presently occupy. If a player that Challenges Loses with a Royal Flush Finesse Card, he will pay only to the players he loses to, the Value of the Space he now occupies and will also pay the Kitty the same per player, Not Double. Whenever a Royal Flush Finesse Card is used in a regular Challenge the Challenger will always Collect Double. A Royal Flush Finesse Card Cancels out another Royal Flush Finesse Card between the players involved.

Royal Flush Table Challenge Play

Whenever a Royal Flush Finesse Card is used on a Table Challenge by the Challenger and he wins the Challenge, he will Collect Three times the Value of the Space the losers presently occupy. If the Challenger loses to just one player on the Table Challenge, he will pay all the players the Value of the Space he occupies, plus pay the Kitty the same per player involved. The Challenger will not pay Triple to any opponent players on a Table Challenge. If there is a tie, the Challenger loses.

Rule 7: Royal Court

The Royal Court is Jack, Queen, and King on the Spinning Wheel. At no time will a player move their Gamie to another Space when one of these are spun on the Spinning Wheel. Before you can play the Royal Court, you must cross the Margin Line. If you spin a Jack, Queen, or King while occupying the Start, Ante or any of the other Documents before crossing the Margin Line, your play will be dead until your next turn.

The Royal Court: Jack, Queen and King each have a value of 10, only for playing Long Shot or Black Jack.

How to Play the Royal Court

The Jack always Collects Double

The Queen always Collects Triple

The King always Collects Quadruple

If one spins a Jack, Queen or King on the Spinning Wheel after crossing the Margin Line, he will receive Double, Triple, or Quadruple the value from the first Collect Space forward, not Win Space, but Collect Space from all the players or the number of players the Document reads.

It is easy to find the Collect Spaces, for all their Values are circled in Red.

Rule 8: Joker [On the Spinning Wheel]

The Joker is not wild. If a player is on Start and spins a Joker, it will count as one spin only. That player will not be entitled to draw a Finesse Card. If a Joker is spun on the Spinning Wheel after a player is off Start, that player will draw one Finesse Card and stay on the space he presently occupies. If playing Black Jack or Long Shot and a Joker is spun, it will count as one spin only. At no time, when a Joker is spun on the Spinning wheel will one move his Gamie.

Rule 9: Scratched

When a player moves his Gamie forward on his turn and lands on a Space that is already occupied by another player, the player occupying the Space will be penalized, (Scratched), and will have to move backwards ten spaces. The player who took over the Space that was already occupied, will then be liable to do what the Documents reads. Anytime a player is moved backwards, (Scratched), by another player, he will not have to play the Document, because it was not his play that moved him backwards. A player must have his Gamie over the Margin Line before he can Scratch another player. No player can be Scratched before crossing the Margin Line. If a player lands on a Space already occupied before the Margin Line, that player will move his Gamie forward to the first open space, and play the Document. If a player moves his Gamie one Space past the Margin Line and Scratches a player occupying this Space, that player Scratched will move backwards ten spaces; in case he lands on a Space already occupied, he will continue backwards to the first open Space and, if necessary, to the Ante. If this happens, the player that moved backwards will not have to Re-Ante. At no time will two players occupy the same Document except: Start, Ante, Triple Crown, Long Shot, Stop and the Staircase Steps, and at no time can a player be Scratched on these Documents. A player at no time can be Scratched on his own Player Number. If a player is occupying his own Player Number on the Playing Board, and and another player lands on this Space, that player will pay the owner of the Number the Highest Value of the Space. He will then move backwards ten Spaces and do what the Document reads, because he moved himself backwards. A player cannot be Scratched or Challenged whenever he is occupying the Safe Pass Document. If a player is occupying the Safe Pass Document and another player lands on this Document, the latter will be Scratched, (moved back ten spaces) and be liable to play the Document.

Anytime a Document on the Playing Board moves a player backwards, he will be liable for the Document he lands on. There are eight of these Documents in the game.

Rule 10: Credit Chips—Credit Notes—Markers—Kool Off Lose Turn Cards

CREDIT CHIPS:

The Cashier will issue a $5.00 Credit Chip 220 to a player when needed, only $20.00 worth of these Chips can be loaned per player. This will help him keep track of the amount of money. Each player will return his Credit Chips as he repays his loans plus interest.

CREDIT NOTES:

At the time a player borrows money and receives his first Credit Chip 220 the Cashier will issue him one Credit Note 223. The backside of the Credit Note describes the amounts of interest to be paid back before and after the game is over to the Cashier. If a player pays his loans, plus interest, that player will return his Credit Note Card and his Credit Chips back to the Cashier, to show that his loan has been paid off.

MARKERS:

If a player has borrowed his limit in Credit Chips 220 and needs more money, the Cashier will issue him a Marker 221. A player may loan another player money if they both agree to do so. All signatures will be required from all the parties involved. The Markers 221 have the amounts that may be loaned and the percentage of interest to be repayed listed on the back.

KOOL OFF LOSE TURN CARDS:

There are six of these Cards 222 in the game. If a player occupies one of the Kool Off Lose Turn Spaces on the Playing Board, the Cashier will issue that player one of these Cards to be turned face up in front of the player, for all the players to view. This Card is to remind a player and all players that he loses his next turn to spin the Wheel. On that player's next turn, he will at that time, give the Kool Off Lose Turn Card 222 back to the Cashier. If he fails to return the Card to the Cashier, he will lose his following turn. He, alone, is responsible for returning his card.

Rule 11: Staircase and Finish

All the players of the game will Stop on the last Document on the Playing Board, which is the Stop Document, and there he will wait until his next turn to spin the Spinning Wheel. When a player reaches this point of the game, he is ready to proceed Step by Step on the Staircase to the Finish.

If a player has an Even Player Number, he must spin an Even Number on the Spinning Wheel in order to move his Gamie one Step on the Staircase. Same goes for Odd Players Numbers. This will be repeated by all the players on their turns until all of the players have completed moving their Gamies on each of the three Steps on the Staircase to the Finish. All players can Challenge or be Challenged on the Staircase Steps, because each Step has a value.

The first player to cross the Finish will win 90% of the money in the Kitty and all of the money in the Ante. At this time, the player that finishes first will take possession of the Kitty and Ante, and then wait until the rest of the players have finished the game. This will keep from interfering with the rest of the players still playing the game. As soon as the first player crosses the Finish, and collects the Kitty and Ante, at that time, the rest of the players in the game may Re-Ante and then continue on with the game. This procedure can be repeated until the last player crosses the Finish. If agreed among the players, the game can end after the first player crosses the Finish.

Anytime a player spins a Joker, Jack, Queen or King on the Spinning Wheel, it will count as a turn spin only. Player will never move his Gamie if any of these are spun on the Wheel. If a Joker is spun, that player will be entitled to draw one Finesse Card.

REMEMBER: The Cashier only collects 10% of the Kitty from the first player that crosses the Finish.

After all the players have crossed the Finish, they can play "Show Down," if they desire. Refer to Rule 12, below.

Rule 12: How to Play Show Down

After all the players have crossed the Finish, they will have one last chance to win money, and this play is called, "Show Down." All players who desire to play will put up four times the present Ante Value. Each player will place one Finesse Card face down on the Playing Board, then at the same time, all the players will turn their Cards over. The player with the Highest Finesse Card will win "Show Down." All the rules of the game will apply to the Show Down play, with one exception: if a Royal Flush Finesse Card is used, you will not win Double, (only four times the Ante Value per player.) Now all the players in the game will turn their remaining Finesse Cards face up in front of them for all players to view. In case of ties, the Cashier will divide the Chips equally between the winners.

Now the game is officially over. The cashier will settle up the House, (Interest owed, etc.), and write down all the players' winnings or losses to determine who won "FORTUNE FINESSE." The Cashier will then read the Evaluation Chart, in accordance to the number of players in the game, and give each player their Status and Ranking.

On the playing board 200, there are small numbers printed on each Value Space on the playing board from the start to the finish. These are the "Standard Numbers" for the Value Spaces and range in sequence from 1 through 139. These numbers are used by the players in setting up the playing board Value Spaces in sequence according to the standard playing board Value Chart below.

STANDARD PLAYING BOARD VALUE CHART

| | | |
|---|---|---|
| 1. .50 Ante | 48. .25 | 94. .40 |
| 2. .50 | 49. .75 | 95. .50 |
| 3. .25 | 50. .50 | 96. .50/$1.00 |
| 4. .20 | 51. .50 | 97. .50/$1.00 |
| 5. .50 | 52. .50 | 98. .25 |
| 6. .25 | 53. .50 | 99. .30 |
| 7. .20 | 54. .25 | 100. .75 |
| 8. .50 | 55. .90 | 101. .20 |
| 9. .30 | 56. .40 | 102. .20 |
| 10. .10 | 57. .25 | 103. .50 |
| 11. .25 | 58. .25 | 104. .50 |
| 12. .50 | 59. .25 | 105. .90 |
| 13. .30 | 60. .50 | 106. .30 |
| 14. .20 | 61. .25 | 107. .20 |
| 15. .50 | 62. .40 | 108. .20 |
| 16. .50 | 63. .50/$1.00 | 109. .25 |
| 17. .50 | 64. .25 | 110. .50 |
| 18. .75 | 65. .25 | 111. $1.00 |
| 19. $2.00 Triple Crown | 66. .50 | 112 .50 |
| 20. $2.00 | 67. .50 | 113. .70 |
| 21. .25 | 68. .50 | 114. .25 |
| 22. .25 | 69. .50 | 115. .30 |
| 23. .50/$1.00 | 70. 1.00 | 116. .50/$1.00 |
| 24. .75 | 71. .25 | 117. .50 |
| 25. .50 | 72. .25 | 118. .20 |
| 26. .30 | 73. .50/$1.00 | 119 $1.00 |
| 27. .50 | 74. .50 | 120 .25 |
| 28. .50/$1.00 | 75. .50 | 121. $1.00 |
| 29. .20 | 76. .50 | 122. .25 |
| 30. .50 | 77. .25 | 123. .30 |
| 31. $1.00 | 78. .75 | 124. .50 |
| 32. $2.00 Long Shot | 79. .80 | 125. .60 |
| 33. $1.00 | 80. .80 | 126. .50/$1.00 |
| 34. .30 | 81. .25 | 127. .50 |
| 35. .25 | 82. .50/$1.00 | 128. .25 |
| 36. .50/$1.00 | 83. .50 | 129 .50 |
| 37. .70 | 84. .40 | 130 .20 |
| 38. .25 | 85. .60 | 131 .50 |
| 39. .40 | 86. .50 | 132. .40 |
| 40. .50 | 87. .80 | 133. .20 |
| 41. .50/$1.00 | 88. .40 | 134. .25 |
| 42. .50 | 89. .70 | 135. .40 |
| 43. .25 | 90. .25 | 136. .70 |
| 44. .30 | 91. .80 | 137. .50 |
| 45. .50 | 92. .70 | 138. .25 |
| 46. .90 | 93. .50 | 139. $1.00 |
| 47. .50/$1.00 | | |

Fortune Finesse is a Versatile Game many can play for Fun or Serious entertainment. Designed with equal balance, for all the players to Compete against each other to Win the most Fortune by using Finesse Tactics, on playing the Documents and Challenging from the Start to the Climactic Finish. A Game in which all the players can converse. Outloud with each other, while Competing, by pointing out the Mistakes and the Wealth of the other players.

To find a Fortune is Luck, but to have a chance to Win a Fortune is exciting and rewarding. The Game of Fortune Finesse will give a player this chance to show his knowledge and skill in active competition, just to see who is the smartest and best in using Finesse. From the Start to the End one will enjoy travelling around the colorful Playing Board while playing the Documents to his advantage. One will always use Finesse in choosing the players with the most Fortune to Collect from; never giving a player the opportunity to build his Wealth where he can Challenge at will, without a second thought or feeling pressure. One should be alert and use his Finesse Cards wisely at all times, sometimes, Challenging just to rid oneself of a Finesse Card so he can draw another one, or to Challenge the other players to keep them from accumulating too many Finesse Cards so they can protect their best Finesse Cards to use later, on their terms. For each player Finesse can pay off. One should be patient and try to accumulate as many Finesse Cards as possible; this will give good Finesse Card protection and will keep the other players from drawing the best Finesse Cards out of one's hand before he has had a chance to use them for his benefit. Always try to be prepared for being Challenged, surely be prepared with one's own best Finesse Card to make a Challenge on your terms when the opportunity exists. For example, one should wait until he sees the other players occupying a Space of High Value and on his turn this will be the time he will use Finesse and Challenge those players. If one plays his Cards right, he will come out on Top. Remember, while one is making his Fortune by playing the Documents and Challenging, the Kitty and Ante are growing into a Fortune. The first player that Finishes on the Staircase will be rewarded the Kitty and the Ante. Remember, the player that uses Finesse with the most Success will be the best in Fortune Finesse.

You are now ready to play the game following the Step-by-Step sequence of instructions given below:

HOW TO PLAY GAME STEP-BY-STEP

1. Read and understand the Rules
2. Understand the Vocabulary and the Document Definitions.
3. Place all ten Pointer Cards, which are the Player Numbers, face down on the Playing Board, after being shuffled.
4. Each player will draw one Player Number. Any players can play partners.
5. Highest Player Number drawn is appointed the "Cashier of the House."
6. Cashier will ask all the players if they want to play on the Standard Board Values or change the Values.
7. If Standard Board is used, the Cashier will issue:
   (a) $10.00 worth of Chips to each player for 2–3 players in game.
   (b) $15.00 worth of Chips for 4 players
   (c) $20.00 worth of Chips for 5 players
   (d) $25.00 worth of Chips for 6–10 players
   (e) One Gamie to each player
   (f) One Finesse Card to each player
8. When Gamies are all on Start, Cashier will spin first.
9. Each player will try to spin on Odd or Even Number on the Spinning Wheel on three different turns. If a Joker, Jack, Queen or King is spun, on any of these turns, they will count as one of the turns spun only. If a player fails to spin an Odd or Even Number, whichever one that pertains to him on his third turn, he will automatically to to Ante, pay Ante and immediately spin again to try to move his Gamie off of the Ante Space.
10. If a player has satisfied spinning an Odd or Even Number, depending on what type Number he owns, he will pay to the Ante Tray the Value of the Ante. At this time, the player will be entitled to move his Gamie to the Ante Space. Immediately, he will spin again, attempting to spin any number 1 to 10 on the Spinning Wheel. If the player spins a number 1 to 10, his official play of the game is started and entitles the player to move his Gamie off the Ante Space.
11. Anytime a player has to return to the Ante Space for any reason, that player will have to repeat the process of spinning any number 1 to 10 again. He will not have to pay the Ante unless directed to by the Document.

12. Now, each player will begin playing the Documents before the Margin Line.

13. After crossing the Margin Line, these plays will go into effect:

(a) Aces will count as 1 or 11.

(b) A player can spin his own Player Number and win money.

(c) A player may Challenge or be Challenged.

(d) A player will play the Royal Court (e) Scratched or be Scratched or Busted

14. Now, all the players will follow the Big Arrows on the 6 Strips from the Start to the Finish.

The play is officially started, so Players "GOOD LUCK." One should use Finesse on Challenges and play his Documents and make a Fortune, do his best on the spins and travel around the colorful board. Each should be sure to refer to the Rules of the game and Vocabulary until he has learned the game.

A few final pointers about the game are set forth here to improve your understanding of the game. Remember, always use Finesse when making your Challenges and wait until the right time for the opponent players to occupy a large Value Space so that you can increase your Fortune.

Study the rules and vocabulary of the game and understand, particularly, the different types of Challenges. The Simple Challenge, the Table Challenge or the Royal Flush Table Challenge. the Document Play Challenge Spaces on the Playing Board, i.e., Spaces 110 and 127. Remember, anytime you win a Challenge, you will collect the Value of the Space the opponent occupies. Anytime you lose a Challenge, you will pay the Value of the Space you occupy plus you will pay the Kitty the same amount per player. If a Vocal Challenge is made by a player, or a playing board Document makes the player challenge the other players, and one of the opponent players is occupying his own Player Number on the playing board, the player who had to Challenge is the automatic loser. One cannot win a Vocal Challenge or a Document Challenge when the opposing player is occupying his own Player Number. One final point to remember is that when playing partners, one should play as if playing by oneself and at the end of the game, the partners will add up their total winnings.

While this invention has been described fully and completely with special emphasis upon a single preferred embodiment, it should be understood that within the scope of the appended claims, the invention may be practiced otherwise than is specifically described herein.

I claim:

1. A board game apparatus comprising a playing board including a plurality of marked spaces interconnected in a first path of progression around said board, a plurality of marked spaces interconnected in a second path of progression forming a closed loop with said first path at spaced intervals therealong, playing pieces for movement by each player along said first or second paths of progression according to the rules of the game, means associated with selected ones of said marked spaces to indicate monetary value for purposes of gain to the player whose playing piece occupies such space, means associated with selected other ones of said marked spaces to indicate monetary value for purposes of loss to the player whose playing piece occupies such space, said means for indicating monetary value on each of said marked spaces comprising means removably secured adjacent to said first named and said second named selected marked spaces for varying the value indicated for any selected marked space, indicia means on said playing spaces directing a player to pay or collect from other players or the cashier or to take specified competitive action, chance means for directing movement of said playing pieces and having indicia corresponding to the numbers or faces of playing cards, and a plurality of cards having indicia of complete playing hands of five cards each ranked according to the game of poker and used by the players competitively to challenge or be challenged by other players when one player's playing piece occupies a selected playing space directing competitive action.

2. A board game apparatus according to claim 1 in which said board is provided with a plurality of recesses in the surface thereof adjacent to said selected marked spaces, and a first plurality of tokens are provided, bearing indicia of monetary value and fitting selected ones of said recesses to indicate the monetary value of said marked spaces.

3. A board game apparatus according to claim 2 in which said tokens have different indicia of monetary value on opposite sides thereof.

4. A board game apparatus according to claim 2 in which selected token-receiving recesses are larger than the other recesses, and selected tokens are of larger size to fit said larger token-receiving recesses.

5. A board game apparatus according to claim 1 in which said chance means comprises a spinnable wheel and, a pointer cooperable with said wheel for indicating at random the numbers or faces thereon.

6. A board game apparatus according to claim 5 in which said board is provided with a pair of securing and locating recesses, and said wheel and pointer include supporting structure fitting said last named recesses to support and locate the same on said board.

7. A board game apparatus according to claim 1 in which said playing board includes indicia in said first path of marked spaces indicating a point in the movement of said playing pieces beyond which the rules of play are varied.

8. A board game apparatus according to claim 1 in which said cards include ones having indicia other than said poker hands, which indicia have a playing value superior to all playing hands except the royal flush, and two of which cards have a value superior to a royal flush.

9. A board game apparatus according to claim 1 in which said cards are used to challenge other players on the challenger's turn to play or as directed by indicia on the playing board, with the challenger winning or losing according to the rank of his card in relation to the card played by the challenged player.

10. A board game apparatus according to claims 1 or 2 or 5 including a second plurality of tokens bearing indicia of monetary value for use by players in the game.

11. A board game apparatus according to claim 1 in which said marked spaces include at least one indicia requiring a player to perform at least one of the following:

pay kitty, win or collect from one or more players, pay or lose to one or more players, operate said chance means and win or pay according to result, draw a card, challenge other players, lose turn, move playing piece a selected distance backward or forward.

12. A board game apparatus according to claim 1 including a plurality of cards for indicating loan transactions between the cashier and a player.

13. A board game apparatus according to claim 1 including a plurality of record slips bearing indicia of loan transactions between players.

14. A board game apparatus according to claim 1 including a plurality of numbered cards assigned to players by chance, said numbered cards being coordinated with select indicia on said marked spaces for directing the course of play on said board.

* * * * *